United States Patent [19]

Cristiani

[11] 4,296,660

[45] Oct. 27, 1981

[54] DEVICE FOR FEEDING ROD-LIKE ARTICLES

[75] Inventor: Athos Cristiani, Bologna, Italy

[73] Assignee: CIR - S.p.A. Divisione SASIB, Bologna, Italy

[21] Appl. No.: 4,873

[22] Filed: Jan. 19, 1979

[30] Foreign Application Priority Data

Jan. 31, 1978 [IT] Italy ..... 12445 A/78

[51] Int. Cl.[3] ..... A24C 5/50; B26D 7/06; B23Q 7/16; B65G 65//42

[52] U.S. Cl. ..... 83/100; 83/152; 83/155; 83/155.1; 83/411 R; 198/689; 198/462; 198/480; 83/161

[58] Field of Search ..... 83/411 R, 152, 155, 83/155.1, 161, 100; 198/689, 462, 480

[56] References Cited

U.S. PATENT DOCUMENTS

| | | | |
|---|---|---|---|
| Re. 19,375 | 11/1934 | Bronander | 198/76 |
| 2,109,148 | 2/1938 | Gwinn | 198/25 |
| 3,067,644 | 12/1962 | Dearsley | 83/411 R |
| 3,094,128 | 6/1963 | Dearsley | 131/94 |
| 3,104,752 | 9/1963 | Rudszinat | 198/22 |
| 3,269,393 | 8/1966 | Ackermann | 131/20 |
| 3,305,128 | 2/1967 | Dearsley | 221/9 |
| 3,513,962 | 5/1970 | Stone et al. | 198/57 |
| 3,565,235 | 2/1971 | Brown | 198/34 |
| 3,799,324 | 3/1974 | Hall | 198/45 |
| 3,957,152 | 5/1976 | Heitmann | 198/34 |
| 4,041,816 | 8/1977 | Shearon | 83/100 |

*Primary Examiner*—Donald R. Schran
*Attorney, Agent, or Firm*—Spencer & Kaye

[57] ABSTRACT

The device for feeding filter plugs to a demand drum comprises, in combination, a gravity-feed hopper containing a supply of multiple length filter rods, the hopper being closed, in correspondence of its bottom end, by a rotating fluted drum wherein each flute of the drum is capable of housing a filter rod. The filter rods, thus removed from the hopper, are cut into three filter plugs, which are delivered, axially aligned, onto a horizontal conveyor belt subdivided into three tracks. As a continuation of the conveyor belt there is provided a horizontal fixed sliding surface onto which the articles slide in three rows, each leading article of the three rows being pushed by the subsequent ones, until the leading article reaches an abutment member, where it is firmly positioned. Also the sliding surface is subdivided into three tracks. In correspondence of the abutment member there is arranged a collecting and offsetting drum, which presents angularly spaced pick-up elements, and is subdivided into three sections (one for each track of the sliding surface), each section being angularly offset with respect to the adjacent one. In this manner, the filter plugs are individually and sequentially collected by the collecting drum and are transferred, the one after the other, onto a demand drum.

8 Claims, 5 Drawing Figures

P
1
2
3
3A
4
5
6
15
16
19
20
101
106
206
205
305
B

DEVICE FOR FEEDING ROD-LIKE ARTICLES

SUMMARY OF THE INVENTION

The present invention relates to a device for feeding rod-like articles. More particularly, the present invention relates to a device for feeding a plurality of cigarette filter plugs individually and sequentially to a demand conveyer of a utilizing machine, such as a machine for making filter tipped cigarettes.

In the filter cigarette making industry, there are known devices which manipulate filter rods presenting a multiple length with respect to the filter plugs utilized by the cigarette making machine. Usually, multiple length filter rods are removed individually from a hopper to which a bulk supply of said rods has been fed, then are severed into two or more axially aligned sections or plugs, and finally the said axially aligned sections are staggered and conveyed in such a manner as to obtain a single row wherein the plugs are arranged the one after the other.

According to the present invention, a device for feeding filter plugs to a demand drum comprises, in combination, a gravity-feed hopper containing a supply of multiple length filter rods, said hopper being closed, in correspondence of its bottom end, by a rotating fluted drum wherein each flute of the drum is capable of housing a filter rod. The filter rods, thus removed from the hopper, are cut into three filter plugs, which are delivered, axially aligned, onto a horizontal conveyer belt subdivided into three tracks. As a continuation of the conveyer belt there is provided a horizontal fixed sliding surface onto which the articles slide in three rows, each leading article of the three rows being pushed by the subsequent ones, until the leading article reaches an abutment member, where it is firmly positioned. Also the sliding surface is subdivided into three tracks. In correspondence of the abutment member there is arranged a collecting and off-setting drum, which presents angularly spaced pick-up elements, and is subdivided into three sections (one for each track of the sliding surface), each section being angularly offset with respect to the adjacent one. In this manner, the filter plugs are individually and sequentially collected by the collecting drum and are transferred, the one after the other, onto a demand drum, where they can be aligned, in a known manner, in a single row.

The above and other features of the invention will appear evident from the following description of a preferred embodiment, made with reference to the attached drawings.

DESCRIPTION OF THE PREFERRED EMBODIMENT

Figure 1:
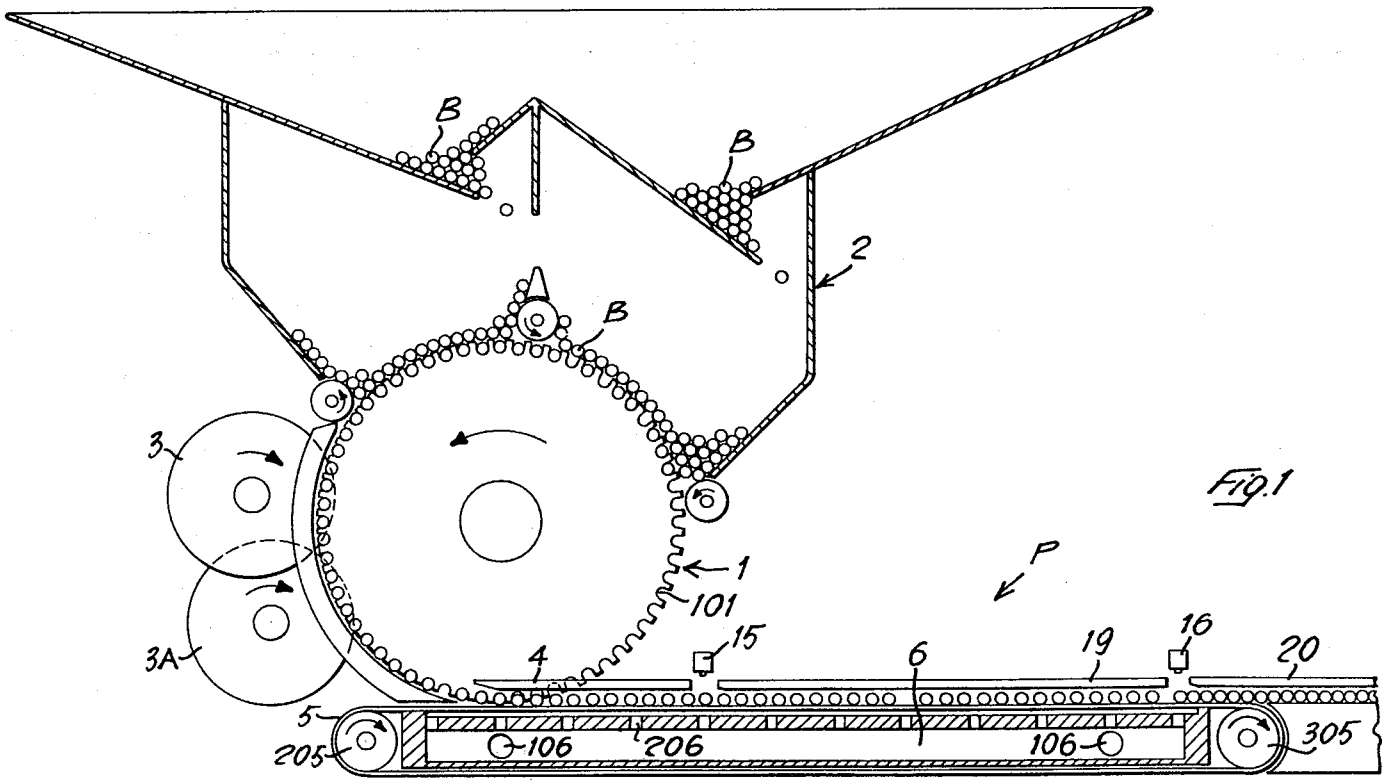
FIG. 1 is a side elevational view, with parts in section, of the hopper, removing drum and horizontal conveyor belt of the device according to the invention.

With reference to the drawings, rod-like articles (rods) B are transferred by a fluted removing drum 1 from gravity-feed hopper 2 to a buffer section P, in the manner which will be described in detail.

Removing drum 1 rotates at the bottom of hopper 2. This hopper contains cigarette filter rods B, and each filter rod B has such a length as to obtain, by cutting, three filter plugs having each a length twice as long as that of the one desired for a cigarette filter.

Drum 1 rotates over a certain arc so as to close the bottom opening of hopper 2 and receives from it the single rods B, into flutes 101. During the following rotation of removing drum 1, rotating blades or cutting means 3 and 3A, operatively associated to the said drum, cut into three segment or plugs F1, F2, F3, the rod B contained in each flute 101. Thus, drum 1 will deliver to buffer P groups of three axially aligned plugs.

Figure 2:
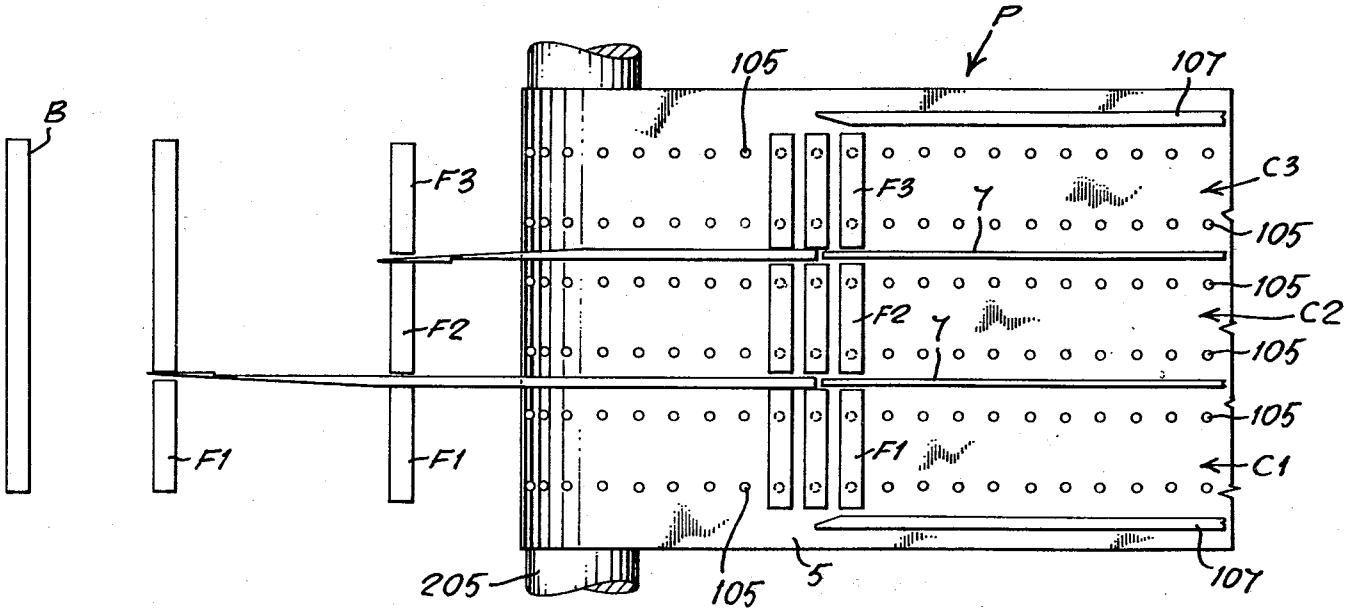
FIG. 2 is a top plan view, with the omission of the hopper and of the removing drum, of the initial portion of the horizontal conveyor belt.

The delivery of these plugs F1, F2, F3 appears clearly from the detail of FIG. 2 where drum 1 has been omitted for the sake of illustration.

With reference to FIGS. 1 and 2, filter plugs F1, F2, F3, which are taken off by strippers 4, are laid on suction tape 5, which holds them in an orderly row, due to pneumatic suction by suction box 6, where vacuum is maintained through suction openings 106, while, through apertures 206 of this box and the aligned apertures 105 of belt 5, suction holds on the belt the group of three aligned segments F1, F2, F3.

Belt 5 is driven on rollers 205, 305 while the side partitions 7, 107 parallel and interspaced between each other, subdivide longitudinally the active surface of belt 5 into three tracks C1, C2, C3, corresponding respectively to the groups of plugs F1, F2, F3.

Figure 3:
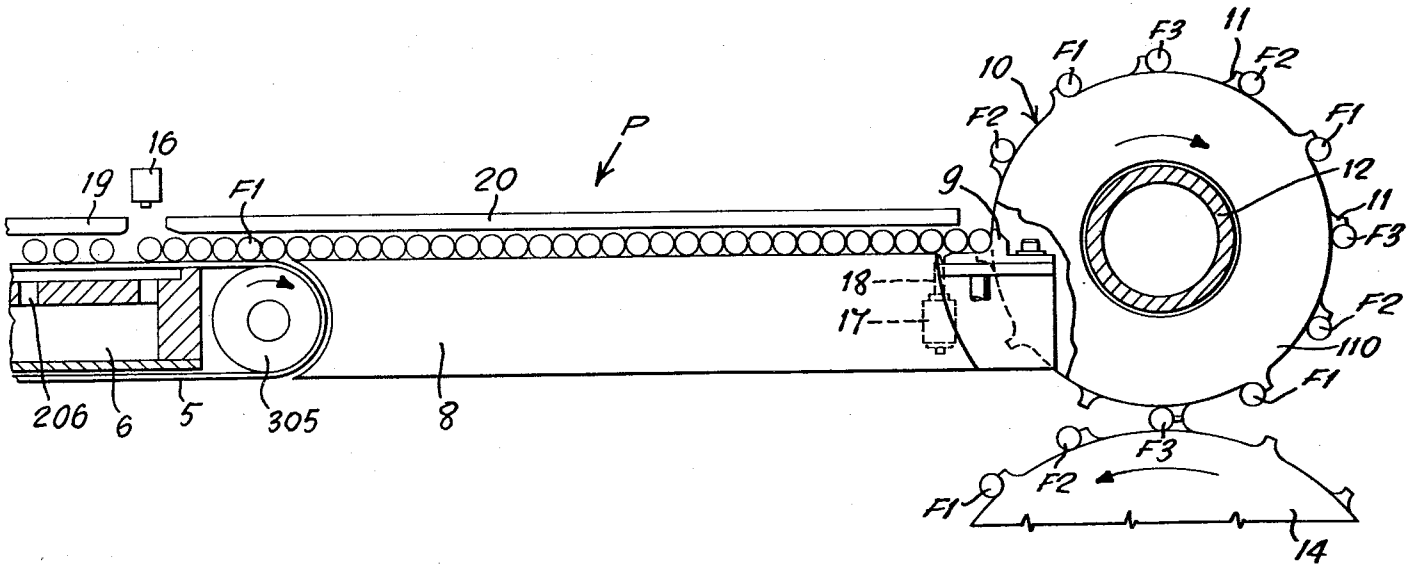
FIG. 3 is a longitudinal side view, with parts in section, illustrating the fixed sliding surface and the collecting and offsetting drum.
Figure 4:
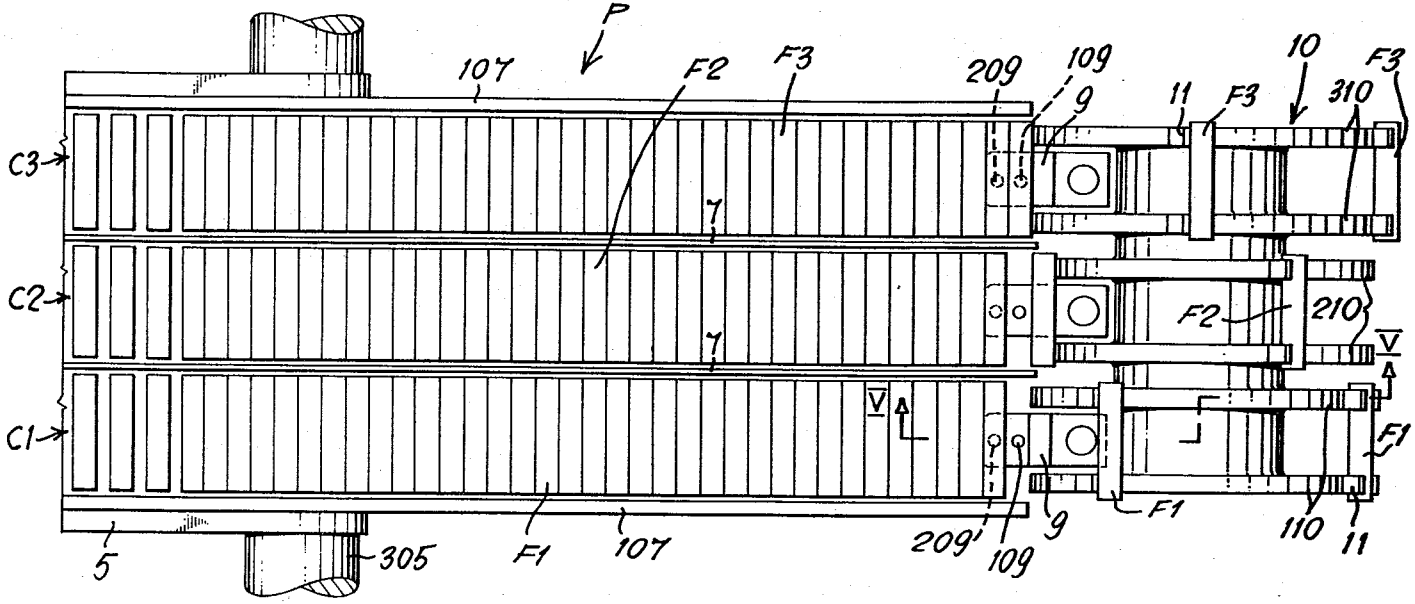
FIG. 4 is a top plan view of the components illustrated in FIG. 3.

The three groups of aligned plugs F1, F2, F3, pneumatically held on belt 5, are transferred by the latter on a fixed horizontal sliding surface 8 (FIG. 3) which is also divided into three tracks by the same side partitions 7, 107 which divide the belt. Surface 8 is a fixed surface located at the same level of the active run of belt 5, directly as a continuation of the same run. On this belt, the plugs F1, F2, F3 can slide freely, moving forward, each pushed by the one arriving behind, carried by the belt. Above the suction belt 5 and the fixed sliding surface 8 there are provided longitudinal guides 19, respectively 20, which define a longitudinal passage for only one article at a time.

Figure 5:
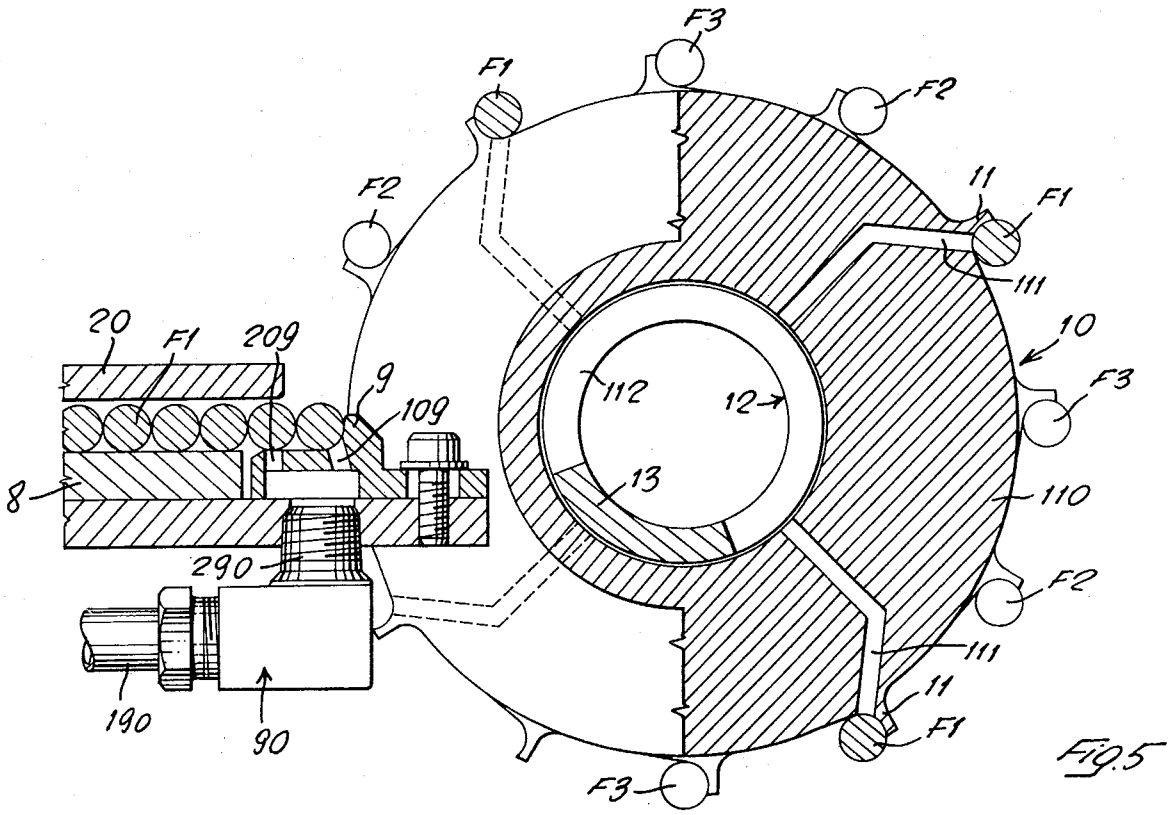
FIG. 5 is a section, in an enlarged scale, taken along lines V—V of FIG. 4 and showing in detail the abutment member provided at the end of the sliding surface, and the collecting and offsetting drum.

At the exit or delivery end of sliding surface 8, each one of tracks C1, C2, C3 terminates with a cradle type abutment member 9. This abutment 9, as it better appears from FIG. 5, has two suction holes 109, 209, spaced between each other of a length corresponding to a rod diameter, in the longitudinal direction of the track. Suction is applied at the same time to these holes by means of a suction pipe 90, jointed to suction tube 190 and connected to the common suction chamber of said holes by means of suction connection 290. Holes 109 and 209 are used to position, respectively, the plug at the beginning of the row and to hold the subsequent plug. Suction belt 5 and sliding surface 8 thus constitute a buffer section P, so that there will always be, against abutments 9 at the delivery end of the three tracks C1, C2, C3 of surface 8, a plug F1, F2, F3 ready to be collected, even if transferring drum 1 fails occasionally to pick some rods B from hopper 2.

In order to collect and offset the plugs of each group F1, F2, F3 so as to deliver them singularly in succession to a demand conveyer, which is usually a fluted drum 14 (see FIG. 3), at the delivery end of these tracks there is arranged a plug collecting and offsetting drum 10.

The drum 10 consists of a tubular shaft which has fitted thereon three reels 110, 210 and 310, each of which consists of a pair of toothed disks. In the illustrated embodiment, each reel consists of two disks, and each disk presents four pick-up elements or teeth 11 angularly equispaced by 90° on the disk periphery. Each pick-up tooth 11 presents a suction duct 111 communicating with central suction duct 12. Duct 12 has a wide circumferential opening which delimits the suction arc and a closed wall 13 which defines the arc of rotation in which no suction is applied to the pick-up teeth 11.

The reels 110, 210, 310 are fitted and fastened on drum 10 with a 30° angular offset the one with respect to the other in the same direction. With this arrangement, at every twelfth of a revolution of drum 10, a plug is collected by a reel, and this collection is cyclically repeated in the sequential order F1, F2, F3, F1. This provides the desired offset which allows the plugs spaced 30° from each other to be transferred on demand to drum 14.

The maximum and minimum capacities of buffer section P are respectively defined by photoelectric cell sensors 15–16 (see FIG. 1).

Drum 1 is operated by a variable speed motor. In normal operating conditions, that is, with the buffer in statistical balance between incoming and outgoing plugs F1, F2, F3, the speed of drum 1 is proportional to the normal speed of the motor which drives it. When the plugs in the buffer section P fall under the minimum level, determined by the position of photoelectric cell 16, then the motor speed is increased so that drum 1 rotates at a higher speed in order to refill the buffer section P with plugs. When photoelectric cell 15 senses the attainment of the full condition, drum 1 is reset to the normal speed.

When the apparatus is started, buffer section P is empty. It is, therefore, necessary to have it initially filled, by preventing for some time the groups of plugs F1, F2, F3, which come from hopper 2, from moving immediately to the collecting drum 10. This is obtained in a very simple manner, by providing an electromagnet actuator 17, the energization of which causes the temporary lifting of a barrier 18 which stops the rows of plugs F1, F2, F3 immediately before they reach the end of the respective tracks C1, C2, C3.

The deenergization of this electromagnet 17 will depend on photoelectric cell 15 which indicates the maximum filling level of buffer section P.

I claim:

1. A device for feeding rod-like articles, such as cigarette filter plugs, comprising, in combination:

(a) a hopper for containing a bulk supply of the articles, said hopper being closed at its bottom end by a rotatable removing drum presenting flutes capable of housing said articles, whereby rotation of the drum causes removal of the articles from the hopper;

(b) a suction belt arranged substantially horizontal below the removing drum to receive from the said removing drum the articles removed from the hopper;

(c) a fixed horizontal sliding surface which receives the articles moving in at least one row transversely to their length, the movement of the articles on the said sliding surface being caused by the pushing action of the articles delivered from the suction belt;

(d) an abutment member provided at the delivery end of the fixed sliding surface, in order to stop the horizontal movement of the leading article of the row of articles on the sliding surface;

(e) a rotatable collecting drum arranged at the delivery end of the fixed sliding surface, and provided with pick-up elements for collecting the leading article which has been stopped by the said abutment member.

2. A device according to claim 1, in which the abutment member presents an upwardly projecting portion which serves as an abutment element, and a suction aperture connected to a vacuum source, for firmly positioning the leading article of each row.

3. A device according to claim 2, in which the abutment member further presents a second suction aperture, arranged prior to the first suction aperture at a distance corresponding to the diameter of an article, for positioning the article in the row which is immediately subsequent to the leading article.

4. A device according to claim 1, in which the pick-up elements on the collecting drum consist of tooth-like projections arranged on the circumference of the drum, each tooth-like projection being associated with a suction aperture which is connected to a source of vacuum with the interposition of suitable valve means.

5. A device according to claim 1, in which the articles are multiple length filter or cigarette rods, further comprising cutting means arranged in the arc of the removing drum between the hopper and the delivery point on the suction belt, said cutting means being provided to cut the articles in at least two segments; and parallel and interspaced side partitions provided along the said suction belt and along the said fixed sliding surface in order to subdivide the said suction belt and sliding surface into at least two parallel longitudinal tracks, each track terminating with an abutment member for stopping the leading segment of each row of segments.

6. A device according to claim 5, in which separate pick-up elements are provided on the collecting drum for each track, said pick-up elements being angularly offset at equal distances for individually and sequentially picking up one after the other the co-axially aligned segments abutting against the abutment members of each track; a demand conveyor being further provided, operatively associated with the collecting drum, for sequentially receiving the segments.

7. A device according to claim 1, in which sensor means are provided for sensing the degree of filling of the sliding surface by the row articles formed on the said sliding surface, said sensor means controlling the speed of rotation of the removing drum which removes the articles from the hopper.

8. A device according to claim 1, in which above the suction belt and above the sliding surface there are provided guide elements defining a passage for only one article at a time.

* * * * *